United States Patent [19]

Lazar et al.

[11] 4,221,563

[45] Sep. 9, 1980

[54] DYE COMPOSITIONS

[75] Inventors: Remus I. Lazar, Berwyn; Richard C. Reichel, Chicago, both of Ill.

[73] Assignee: Velsicol Chemical Corporation, Chicago, Ill.

[21] Appl. No.: 969,899

[22] Filed: Dec. 15, 1978

[51] Int. Cl.[2] ..... D06P 3/14; D06P 3/24; D06P 3/06

[52] U.S. Cl. ..... 8/582; 8/524

[58] Field of Search ..... 8/173, 92

[56] References Cited

U.S. PATENT DOCUMENTS

| | | | |
|---|---|---|---|
| 3,124,412 | 3/1964 | Fidell et al. | 8/173 X |
| 3,932,128 | 1/1976 | Beaulieu | 8/173 |

*Primary Examiner*—Sandra M. Person

*Attorney, Agent, or Firm*—Dietmar Olesch; Robert J. Schwarz

[57] ABSTRACT

This invention discloses compositions and methods for dyeing natural proteinaceous and synthetic polyamide fibers, particularly wool, silk and nylons, utilizing acid dyes and dye assistants comprising mixtures of butyl benzoate either with p-benzyl phenol or with a mixture of methyl toluates and methyl benzoate.

6 Claims, No Drawings

DYE COMPOSITIONS

BACKGROUND OF THE INVENTION

1. Field of the Invention

This invention relates to the dyeing of natural proteinaceous and synthetic polyamide fibers, particularly nylons.

2. Description of the Prior Art

The dyeing of nylons—manufactured fibers in which the fiber-forming substance is any long chain synthetic polyamide having recurring amide groups as part of the chain—may, depending on the specific type of nylon involved—be accomplished with many different classes of dyestuffs e.g.: basic, acid, disperse, direct, etc. The acid dyes, which are in wide commercial use, are the class of dyestuffs utilized in this invention. For reasons of speeding of dyeing, maximum utilization of dyestuffs and improving evenness of color and trueness of hue throughout the dye fiber, dyestuffs are generally used in conjunction with "assistants" (sometimes designated as "carriers")—materials which promote the attainment of speedy dyeing, maximum dye utilization, etc.

Butyl benzoate and p-benzyl phenol are used commercially as dye assistants for nylons, however it was found in this work that p-benzyl phenol used as the sole effective component of a dye assistant for a particular specialty nylon, while giving high color intensity, gave poor evenness of color throughout the dye fiber. Unexpectedly, mixtures of p-benzyl phenol with butyl benzoate were found to be dye assistants which provide color intensity levels higher than those found with the individual compounds at the same level of concentration. And in addition, with the aforementioned specialty nylon, the mixture gave excellent evenness of color. Mixtures of lower alkyl esters of benzoic and toluic acid were disclosed in our U.S. Patent Applications Ser. Nos. 912,170 and 912,656 both filed June 5, 1978, as being effective, in combination with anyone of the materials listed below, as a dye assistant for acid and disperse dyes: alkyl esters of chlorinated benzoic acid, dibenzyl ether, dicyclopentenyl alcohol, methyl cellosolve benzoate, ethyl cellosolve benzoate and (3 hydroxy, 1-butoxy) tricyclo[5,2,1,$0^{2,6}$]-4-decene. It has now been found that combination of butyl benzoate and this benzoic/toluic ester mixture can provide dye assistants which are more efficient than equal concentrations of the individual components of the mixture.

SUMMARY OF THE INVENTION

In accordance with this invention, there have been found dye assistants comprised of either (a) a mixture of butyl benzoate and p-benzyl phenol or (b) a mixture of butyl benzoate with a mixture of lower alkyl esters of benzoic and toluic acids which are effective in the dyeing of natural proteinaceous or synthetic polyamide fibers with acid dyestuffs.

DESCRIPTION OF THE PREFERRED EMBODIMENTS

Any of the lower alkyl esters (where lower alkyl is an alkyl radical of from one to six carbon atoms) of benzoic acid and of ortho, meta, and para-toluic acids are usable in this invention. While the ratio of about 75:25 weight/weight alkyl toluates (ortho, meta or para):alkyl benzoate is preferred, ratios of from about 25:75 to about 90:10 weight/weight can be used in this invention. The preferred alkyl ester mixture is comprised of about 75 weight percent methyl para-toluate and 25 weight percent methyl benzoate. This mixture is commercially available under the designation "Methyl-P-Toluate/Benzoate"; for convenience, such mixture will hereinafter be referred to as "MPTB". MPTB is used industrially in dyeing of nylon with disperse dyes.

Both butyl benzoate and p-benzyl phenol are used commercially as individual dye assistants in the dyeing of nylon with acid dyes. It was found that, with certain specialty nylons comprised of 40% or greater of the polycondensation products of 4.4'-diamino-dicyclohexylmethane or alkylated derivatives thereof, and decanodicarboxylic acid, (these nylons are often referred to by E. I. DuPont DeNemours and Company's Trademark of "QIANA"). p-benzyl phenol when used as the sole effective dye assistant with acid dyes, while giving good color intensity, gave a "muddy" appearance characteristic of uneven coloration throughout the fiber. When used in the dyeing of the aforedescribed specialty nylon with acid dyes, dye assistants comprising combinations of butyl benzoate with p-benzyl phenol unexpectedly gave even coloration throughout the fiber and exhibited a synergistic effect in that the color intensity produced with the combination was greater than that produced with either of the materials used alone at the same concentration. Similar synergestic color-enhancing effects were found when dye assistants comprising combinations of butyl benzoate with MPTB were used in dyeing of the aforedescribed specialty nylon with acid dyes.

The assistants of the present invention are essentially insoluble in water and to be effective in the normally-used aqueous dye baths must be emulsified or otherwise dispersed in water. A convenient method of supplying these assistants for industrial use is as emulsifiable concentrates—a mixture of emulsifying agents and assistants which, when stirred with a minimum of energy into water, will give a usable emulsion. To be formulated into emulsifiable concentrates, the assistant must be in the liquid phase. Butyl benzoate is a liquid at room temperature. Commercial MPTB has a solidification point of about 64° F. and so is liquid at the usual room temperature of 68° F. and above. If it is desired to test MPTB as the sole effective assistant and it has been cooled enough to solidfy, it is warmed until completely liquid before preparing the emulsifiable concentrate. p-benzyl phenol is a solid and in this invention, is used in solution in Butyl Benzoate. For the purpose of illustrating the effect of p-benzyl phenol by itself as the sole assistant, it was formulated into a 20 weight percent solution in xylene, this solution was then formulated into an emulsifiable concentrate.

When the mixtures of this invention are used as dye assistants, they are first prepared then formulated into emulsifiable concentrates. Of the effective components of these mixtures, butyl benzoate may be from 50 to 95 weight percent with p-benzyl phenol or MPTB making up the remaining 50 to 5 weight percent, however mixtures wherein butyl benzoate is from 70 to 90 weight percent and p-benzyl phenol or MPTB from 30 to 10 weight percent are preferred.

While the amount and type of emulsifying agent for specific dyes and fibers is determined by experience and experiment, a generally useful emulsifier system is one containing both anionic and non-ionic emulsifiers. Typical of anionic emulsifiers is the isopropylamine salt of dodecylbenzene sulfonic acid, of non-ionic emulsifiers is a polyoxyethylene derivative of castor oil. A typical emulsifiable concentrate might contain 80 weight percent of assistant, 20 weight percent emulsifiers.

Various amounts of the aforedescribed assistants can be used in order to accomplish the results of the present invention. The use of excess assistant while possible, is wasteful since after an efficient amount has been added, no additional beneficial results are achieved by an excess. The amount of assistant to be used, expressed as a weight ratio of assistant-to-dye should be between 1:1 and 20:1, the precise amount depending on the fiber-dye-process conditions. (By "assistant" is meant the effective components of a formulation, i.e. the butyl benzoate, MPTB, p-benzyl phenol or their mixtures.) The amount of dye in the dye bath is commonly expressed as a weight percentage on-weight-of-fiber (OWF) and may be from about 0.1 to 10 with OWF percentages of from 1 to 5 being typical of commercial practice.

"Acid dyes" are in general salts of organic acids wherein the colorant portion of the dye is the anionic (negatively charged) moiety. The assistants of this invention are useful with fibers which can be dyed effectively with acid dyes, such fibers include the natural proteinaceous fibers such as wool and silk and the synthetic polyamide fibers such as the different types of nylons (e.g. nylon 66 or the aforedescribed specialty nylons).

The actual procedures described in the Example below for the applying of dyes to fibers using the dye assistants of the present invention, are typical of those suggested for superatmospheric pressure dyeing of the aforedescribed specialty nylons which require relatively rigorous dyeing conditions. (See, for example, pp. 321-327, "Book of Papers, 1974 National Technical Conference" published in 1974 by the American Association of Textile Chemists and Colorists). Less rigorous conditions would be usable with nylons such as nylon 66 into which dyes diffuse more rapidly. With the appropriate modification in processing, other methods of applying the dye—such as printing, padding, spraying onto the fiber, etc. are usable.

In addition to dyes and dye assistants, dyeing formulations usually contain various auxiliary agents. These agents can include emulsifiers, anionic, cationic or nonionic, for emulsifying or dispersing the dye and dye assistant in water. pH control may be accomplished by the addition of formic acid, acetic acid and the like. Sodium phosphate may be used for water softening, natural or artifical gums may be used to control the thickness of the formulation, surfactants may be used to improve wetting of the fabric, etc. The decision as to what and how much auxiliary to use and the sequence of addition usually rests with the dyemaster, his decisions being made on the basis of his experience of dyeing in general and of the fibers and dyes used in a particular dyeing operation. In the Example below, a blend of the isopropylamine salt of dodecylbenzene sulfonic acid and a polyoxyethylated castor oil is used to emulsify the dye assistants, sodium hexametaphosphate is used for wetting purposes, mono-sodium phosphate is used as a buffer for pH control and sodium N-methyl-N-oleoyl taurate is a surfactant/emulsifier. This invention, however, is not limited to these particular auxiliaries nor the proportions used.

The compositions of the present invention contemplate dye preparations containing the aforedescribed combinations as essential dye assistants and an acid dye. The pH of these compositions may be any value commonly used for acid dyeing—typically from about 3 to slightly below 7; the dyebath described below has a pH of about 6.5. These compositions can have as optional additional components the aforementioned general type of auxiliary agents to control the physical and chemical conditions of the dyeing. The specific additives to be used and their amounts depend upon the particular fiber to be dyed and on the operating conditions chosen.

The following Example illustrates methods of preparing and applying the dye compositions of the present invention, which is not limited to the procedure or materials therein described.

The dyes are representative of the classes of acid dyes and were chosen to give the three primary colors of red, blue and yellow since by suitable combination of these colors it is possible to obtain a wide variety of hues. Unless otherwise specified all temperature are in degree Celsius, weights in grams and volumes in milliliters.

EXAMPLE

PREPARATION OF DISPERSE OR ACID DYEBATH COMPOSITION AND DYEING PROCEDURE

Experimental dye assistants were first formulated into emulsifiable concentrates by admixture at 30°-40° C. with emulsifiers to make homogeneous:

| Emulsifiable Concentrate, All Assistants Other than p-Benzyl Phenol | |
|---|---|
| Dye Assistant | 80 parts weight |
| Trydet 3300 | 15 |
| Trylox CO-40 | 5 |
| | 100 |

The "Dye Assistant" designated above is one hundred percent active material. Butyl benzoate and MPTB were formulated as such into emulsifiable concentrate mixtures, e.g. 90:10 weight:weight butyl benzoate: p-benzyl phenol were prepared first, then formulated. In the experiment using p-benzyl phenol as the sole assistant, a 20 weight percent solution in xylene was necessary, therefore, in order to obtain an emulsifiable concentrate containing the same ratio of active assistant to emulsifiers as with the other concentrates, the following formulation was used.

| Emulsifiable Concentrate, p-Benzyl Phenol | |
|---|---|
| p-Benzyl phenol, 20 weight percent in xylene, 400 parts by weight | |
| Trydet 3300 | 15 |
| Trylox CO-40 | 5 |
| | 420 |

(Trydet 3300 is the isopropylamine salt of dodecylbenzene sulfonic acid, Trylox CO-40 is a polyoxyethylene derivative of castor oil. Both materials are products of Trylon Chemical Corporation, a division of Emery Industries, Inc.).

To an Atlas Electric Devices Company's Launder-Ometer, Model LHTP, stainless steel test container were charged:

Approximately 300 ml tap water at about 50° C.;
5 ml of 3% (wt) solution of sodium hexametaphosphate;
5 ml of 3% (wt) solution of monosodium phosphate;

5 ml of 3% (wt) solution of sodium N-methyl-N-oleoyl taurate (Igepon T-51, a product of GAF Corporation);

1 ml of an aforedescribed emulsifiable concentrate of p-Benzyl Phenol; or 17 ml of the aforedescribed emulsifiable concentrate of p-Benzyl phenol solution.

This quantity of p-benzyl phenol emulsifiable concentrate contains the same weight of active material as the 1 ml quantities of non-p-benzyl phenol emulsifiable concentrates.

The tap water used in this example had a hardness of about 40 parts per million, but the invention is not limited to water of this hardness. The degree of hardness permissible depends upon the conditions peculiar to a particular dye formulation/fiber combination and a dyemaster will use water softeners to adjust hardness if he deems this necessary.

The above mixture was stirred until it became homogeneous. Then 0.2 gram (2 percent on-weight-of-fiber) of the dye to be used in the experiment was dissolved in about 84 ml of lukewarm tap water and this solution added to the above mixture. This final mixture was the completed dyebath and was, if necessary, adjusted to a volume of 400 ml by addition of tap water so as to give, with a 10 gram fiber sample, a bath-to-fiber ratio of 40:1. A 10 gram sample of the aforedescribed specialty nylon (type 470 or type 472, either giving substantially the same dyeing results, made by E. I. DuPont de Nemours & Company, Inc. and in the form of swatch of Qiana® (DuPont's T.M.) fabric obtained from Testfabrics, Inc., their Style 324) was next added to the dyebath and the preparation stirred. The stainless steel container was then sealed pressure-tight and placed in the Launder-Ometer which was then switched "on" (at all times during the "on" condition, the dyebath was stirred by reason of its container being continually rotated in a manner which regularly inverted and righted it thus imparting a sloshing motion to the contained dyebath). The Launder-Ometer bath temperature was then rapidly (about 15 minutes) raised from room temperature (20°-25° C.) to 70° C. at which temperature the programmed heating mode of the Launder-Ometer was used to bring the bath temperature from 70° C. to 100° C. over a period of 45 minutes and from 100° C. to 130° C. over a period of 30 minutes. The bath was then held for one hour at 130° C. with the container contents under autogeneous pressure.

At the conclusion of this period, the programmed cooling mode of the Launder-Ometer was used to cool the bath to approximately 50° C. over a period of 50 to 60 minutes and the Launder-Ometer switched to "off".

After cooling, the container was removed from the Launder-Ometer, and emptied of its liquid contents. The degree of exhaustion of the dye was visually noted and observations made of loss dyebath or of presence of glycerin in the container both of which conditions were caused by faulty sealing of the container. No data were taken from runs showing such signs of leakage; the experiment was repeated until a satisfactory run was obtained.

The swatch was rinsed in lukewarm tap water and then washed by adding to its container 200 ml of solution, at 70° C., containing 1% of an alkyl aryl polyether surfactant (Triton X-100, product of Rohm & Hass Company) and 1% sodium pyrophosphate ($Na_4P_2O_7 \cdot 10\ H_2O$) and soaking for 10 minutes. The swatch was then washed with lukewarm tap water until free of the surfactant/phosphate wash solution. After drying at room temperature from 16 to 24 hours, the swatch was heated in a forced draft oven for about 3 minutes at 193° C. in order to free it of the last trace of dye assistant and to stabilize the dye. It was then ironed to help eliminate wrinkles and the effectiveness of the dye assistant evaluated. (With the aforedescribed specialty nylon, an alternate technique of obtaining wrinkle-free dyed fabric is, before the dyeing procedure, to subject the fabric to temperature of about 180° C. for about 10 seconds. This heat treatment makes the material more resistant to wrinkling.) This effectiveness is a combination of a number of performance factors which a dyemaster would not normally measure quantitatively, but would subjectively evaluate and integrate to get an overall estimate of the merit of the assistant. These factors include: completeness of exhaustion of dye from the dyebath (the more complete, the better the assistant) trueness of hue and intensity of saturation of the color of the dye fiber and evenness of "levelness" of dyeing—i.e. there are no darker or lighter areas on the dye fiber. The above factors were evaluated for each dye and dye assistant combination tested in this experimental work.

While a dyemaster usually would classify an assistant as highly effective or moderately effective or of low effectiveness with no attempt to further quantitate his judgement, a numerical scale is adopted here to better show up differences between assistants. This scale is shown in Table 1 below and refers to the effectiveness of the assistant as regards all of the aforedescribed effectiveness factors other than the assistants' ability to promote evenness of coloration ("levelness") throughout the fiber. The leveling ability is noted in Table 1 as a separate factor.

| Experimental Designation | DYE DESCRIPTION |
|---|---|
| 1. | Capracyl Red B (C.I. Acid Red 182, product of E. I. DuPont de Nemours & Company, Inc. |
| 2. | Supralan Yellow NR (C.I. Acid Yellow 121, C.I. No. 18790), product of GAF Corporation. |
| 3. | Alizarine Supra Blue A (C.I. Acid Blue 25, C.I. No. 62055), product of GAF Corporation. |

The following individual materials, and combinations were employed as dye assistants. Comparison of the results for the individual materials with those for the combinations illustrates the synergistic effects found.

| Experimental Designation | DYE ASSISTANT (Ratios by Weight) |
|---|---|
| A | Butyl Benzoate |
| B | p-Benzyl Phenol |
| C | MPTB |
| D | 90/10 Butyl Benzoate/p-Benzyl Phenol |
| E | 90/10 Butyl Benzoate/MPTB |

TABLE 1

| DYE | EFFECTIVENESS RATINGS AND LEVELING ABILITY OF DYE ASSISTANTS | | | | | |
|---|---|---|---|---|---|---|
| | 1 | | 2 | | 3 | |
| DYE ASSISTANT | EFFECTIVENESS (1) | LEVELNESS | EFFECTIVENESS | LEVELNESS | EFFECTIVENESS | LEVELNESS |
| A | 8 | Good | 8 | Good | 8 | Good |
| B | 9 | Poor | 9 | Poor | 9 | Poor |
| D | 8 | Good | 8 | Good | 8 | Good |
| A | 8 | Good | 8 | Good | 8 | Good |
| C | 6 | Good | 6 | Good | 7 | Good |
| E | 9 | Good | 9 | Good | 9 | Good |

(1) A rating of 1–3 indicates low effectiveness, 4–6 medium effectiveness and 7–9 high effectiveness.

The above Example has been described in the foregoing specification for the purpose of illustration and not limitation. Many other modifications and ramifications will naturally suggest themselves to those skilled in the art based on the disclosure. These are intended to be comprehended as within the scope of this invention.

The embodiments of the invention in which an exclusive property or privilege is claimed are defined as follows:

1. A dye composition for the dyeing of natural proteinaceous and synthetic polyamide fibers which comprises one part by weight of an acid dyestuff and 1 to 20 parts by weight of a dye assistant comprising a mixture of 70 to 90 weight percent butyl benzoate and 30 to 10 weight percent of a mixture consisting essentially of from 10 to 90 weight percent lower alkyl toluates and from 90 to 10 weight percent lower alkyl benzoates.

2. In the process of dyeing of natural proteinaceous and synthetic polyamide fibers, the improvement which comprises applying thereto an effective amount of the composition of claim 1.

3. The process of claim 2 wherein the synthetic polyamide fiber is nylon.

4. The process of claim 2 wherein the synthetic polyamide fiber is comprised of 40% or more of the condensation product of 4,4'-diaminodicyclohexyl methane, or alkylated derivatives thereof, and decanodicarboxylic acid.

5. A textile fiber dyed by the process of claim 2.

6. The dye composition of claim 1 wherein the acid dyestuff is selected from the group consisting of C.I. Acid Red 182, C.I. Acid Yellow 121 and C.I. Acid Blue 25.

* * * * *